US011146012B2

(12) United States Patent
Nakamura

(10) Patent No.: US 11,146,012 B2
(45) Date of Patent: Oct. 12, 2021

(54) POWER CONNECTOR HAVING INTERLOCK FUNCTION AND POWER CONNECTOR DEVICE USING POWER CONNECTOR

(71) Applicant: HIROSE ELECTRIC CO., LTD., Tokyo (JP)

(72) Inventor: Koichi Nakamura, Tokyo (JP)

(73) Assignee: HIROSE ELECTRIC CO., LTD., Tokyo (JP)

( * ) Notice: Subject to any disclaimer, the term of this patent is extended or adjusted under 35 U.S.C. 154(b) by 0 days.

(21) Appl. No.: 16/668,007

(22) Filed: Oct. 30, 2019

(65) Prior Publication Data

US 2020/0161794 A1 May 21, 2020

(30) Foreign Application Priority Data

Nov. 2, 2018 (JP) ..... JP2018-207547

(51) Int. Cl.
*H01R 13/40* (2006.01)
*H01R 13/436* (2006.01)
(Continued)

(52) U.S. Cl.
CPC ..... *H01R 13/4365* (2013.01); *H01R 13/2407* (2013.01); *H01R 13/631* (2013.01)

(58) Field of Classification Search
CPC ..... H01R 13/4365; H01R 13/2407; H01R 13/631; H01R 13/436; H01R 13/422;
(Continued)

(56) References Cited

U.S. PATENT DOCUMENTS 5,266,047 A * 11/1993 Black ..... H01R 13/631 439/364
5,273,456 A * 12/1993 Muzslay ..... H01R 13/641 439/188

(Continued)

FOREIGN PATENT DOCUMENTS

JP 5375440 12/2013

*Primary Examiner* — Harshad G Patel
(74) *Attorney, Agent, or Firm* — Rankin, Hill & Clark LLP

(57) ABSTRACT

To provide a power connector etc. configured to prevent dimension enlargement in an array direction of fitting portions even in the case of providing attachment portions for attaching interlock connectors.

A power connector includes a housing having at least two fitting portions each fittable to at least two partner fitting portions of a partner connector in an abutting state, at least two terminals each arranged at the fitting portions, and at least one interlock connector attached to an attachment portion of the housing. When the fitting portions and the partner fitting portions are fitted to each other, the terminals are electrically connected to partner terminals each provided at the partner fitting portions, and the interlock connector is in conduction with a partner interlock connector provided at the partner connector. At an abutting surface of the fitting portions and the partner fitting portions, the attachment portion is positioned between peripheral edges of the fitting portions, and is arranged in a region excluding a most-proximal portion where the peripheral edges of the fitting portions are closest to each other in an array direction of the fitting portions.

10 Claims, 12 Drawing Sheets

(51) Int. Cl.
*H01R 13/24* (2006.01)
*H01R 13/631* (2006.01)

(58) Field of Classification Search
CPC .. H01R 13/424; H01R 13/426; H01R 13/428; H01R 13/24; H01R 13/22; H01R 13/20; H01R 13/10; H01R 13/02; H01R 13/629; H01R 13/627; H01R 13/62; H01R 13/40
USPC ..... 439/595
See application file for complete search history.

(56) References Cited

U.S. PATENT DOCUMENTS

| | | | | |
|---|---|---|---|---|
| 5,993,255 | A * | 11/1999 | Yurko | H01R 13/631 439/364 |
| 8,257,107 | B2 * | 9/2012 | Tsuruta | H01R 13/6581 439/362 |
| 8,491,344 | B2 * | 7/2013 | Ishibashi | H01R 13/4223 439/752.5 |
| 9,004,954 | B2 * | 4/2015 | Baldwin | H01R 13/6456 439/680 |
| 9,500,812 | B2 * | 11/2016 | Tanaka | H01R 13/645 |
| 10,476,209 | B2 * | 11/2019 | Kitagawa | H01R 13/6581 |
| 10,608,364 | B2 * | 3/2020 | Blakborn | H01R 13/2421 |
| 10,873,147 | B2 * | 12/2020 | Ueberschlag | H01R 13/44 |
| 2011/0053404 | A1 | 3/2011 | Tsuruta et al. | |
| 2012/0149226 | A1 * | 6/2012 | Ishibashi | H01R 13/5221 439/271 |
| 2015/0325961 | A1 * | 11/2015 | Blakborn | H01R 13/6581 439/271 |

* cited by examiner

POWER CONNECTOR HAVING INTERLOCK FUNCTION AND POWER CONNECTOR DEVICE USING POWER CONNECTOR

TECHNICAL FIELD

The present invention relates to a power connector used in, e.g., a power system of an automobile, specifically a power connector having an interlock function for sensing the state of fittable connection to a partner connector, and a power connector device using the power connector.

BACKGROUND ART

Japanese Patent No. 5375440 (Patent Literature 1) describes one example of a connector device having an interlock function, the connector device including a male-side connector and a female-side connector fittably connected to each other.

The male-side connector includes a male-side connector housing and a male-type terminal fitting attached to the male-side connector housing. At an abutting surface of the male-side connector housing on the side of fittable connection to the female-side connector, a pair of fitting spaces each fittable to fitting portions of the female-side connector are formed side by side with a predetermined distance. In each fitting space, a pin terminal portion of the male-type terminal fitting protrudes, and an interlock portion to which an interlock connector is to be attached is provided between the pair of fitting spaces separated from each other.

The female-type connector includes a female-side connector housing and a female-type terminal fitting attached to the female-side connector housing. At an abutting surface of the female-side connector housing on the side of fittable connection to the male-side connector, a pair of fitting portions are integrally formed side by side with a predetermined distance, and between tip end portions of the fitting portions, an interlock fitting portion is provided with a predetermined gap from each fitting portion. A short-circuit terminal is attached to the inside of the interlock fitting portion, and is fittably connected to the interlock connector attached to the interlock portion of the male-type connector so that the state of fittable connection between the male-type connector and the female-type connector can be detected. Further, a mechanism is employed, in which when the female-type connector is fittably connected to the male-type connector and a pin terminal portion provided at the male-side terminal fitting is connected to the female-side terminal fitting of the female-side connector, the interlock connector is fittably connected to the interlock fitting portion and a power circuit is brought into a power distributable state by closing of, e.g., a relay due to sensing of a fittable connection state by a not-shown fitting sensing circuit.

In a typical power connector having the interlock function as disclosed in Patent Literature 1, the pair of fitting portions to be fitted to terminal portions of the partner connector is apart from each other in a lateral direction, i.e., an array direction of the fitting portions, for providing the attachment portion for attaching the interlock connector performing interlock. Thus, there are problems that a dimension in the lateral direction increases and the connector and the connector device using such a connector are enlarged.

CITATION LIST

Patent Literature

[PATENT LITERATURE 1] Japanese Patent No. 5375440

SUMMARY OF THE INVENTION

Problems to be Solved by the Invention

The invention of the present application has been made for solving the problems in the above-described typical technique, and is intended to provide a power connector configured to prevent dimension enlargement in an array direction of fitting portions even in the case of providing attachment portions for attaching interlock connectors and a power connector device using such a power connector.

Solutions to the Problems

For solving the above-described problems, a power connector according to one aspect of the present invention includes a housing having at least two fitting portions each fittable to at least two partner fitting portions of a partner connector in an abutting state, at least two terminals each arranged at the at least two fitting portions, and at least one interlock connector attached to an attachment portion of the housing. When the at least two fitting portions and the at least two partner fitting portions are fitted to each other, the at least two terminals are each electrically connected to at least two partner terminals each provided at the at least two partner fitting portions, and the at least one interlock connector is configured to be in conduction with a partner interlock connector provided at the partner connector. At an abutting surface of the at least two fitting portions and the at least two partner fitting portions, the attachment portion is positioned between peripheral edges of the at least two fitting portions, and is arranged in a region excluding a portion included in a most-proximal portion where the peripheral edges of the at least two fitting portions are closest to each other in an array direction of the at least two fitting portions.

In the power connector of the above-described aspect, at the abutting surface, the attachment portion preferably includes at least two attachment portions provided at positions sandwiching the portion included in the most-proximal portion in a direction perpendicular to both of a fitting direction of the at least two fitting portions and the at least two partner fitting portions and the array direction.

Moreover, in the power connector of the above-described aspect, the abutting surface preferably substantially has a bilaterally-symmetrical shape.

In the power connector of the above-described aspect, at the abutting surface, the attachment portion may be positioned at the center between the at least two fitting portions in the array direction.

In the power connector of the above-described aspect, the at least two terminals each have terminal portions extending along the fitting direction of the at least two fitting portions and the at least two partner fitting portions when arranged at the at least two fitting portions, and the terminal portions are each electrically connected to the at least two partner terminals when the at least two fitting portions and the at least two partner fitting portions are fitted to each other.

Moreover, in the power connector of the above-described aspect, at the abutting surface, each terminal portion may be positioned at the substantially center of the peripheral edge of a corresponding one of the at least two fitting portions.

Further, in the power connector of the above-described aspect, the outside of each terminal portion at the abutting surface is preferably in a substantially circular shape.

In addition, in the power connector of the above-described aspect, each terminal portion may be formed in a tubular shape.

Moreover, in the power connector of the above-described aspect, each of the at least two terminals is formed from a single plate-shaped body.

Further, in the power connector of the above-described aspect, the at least two fitting portions may be formed as recessed portions recessed along the fitting direction of the at least two fitting portions and the at least two partner fitting portions, and the at least two partner fitting portions may be formed as raised portions protruding along the fitting direction.

Effects of the Invention

According to the invention of the present application, the power connector configured to prevent dimension enlargement in the array direction of the fitting portions even in the case of providing the attachment portions for attaching the interlock connectors and the power connector device using such a power connector are provided.

DESCRIPTION OF THE EMBODIMENTS

Hereinafter, one preferred embodiment of the present invention will be described with reference to the attached drawings. Although only the preferred embodiment will be described, such an embodiment is not intended to limit the present invention, needless to say.

Figure 1:
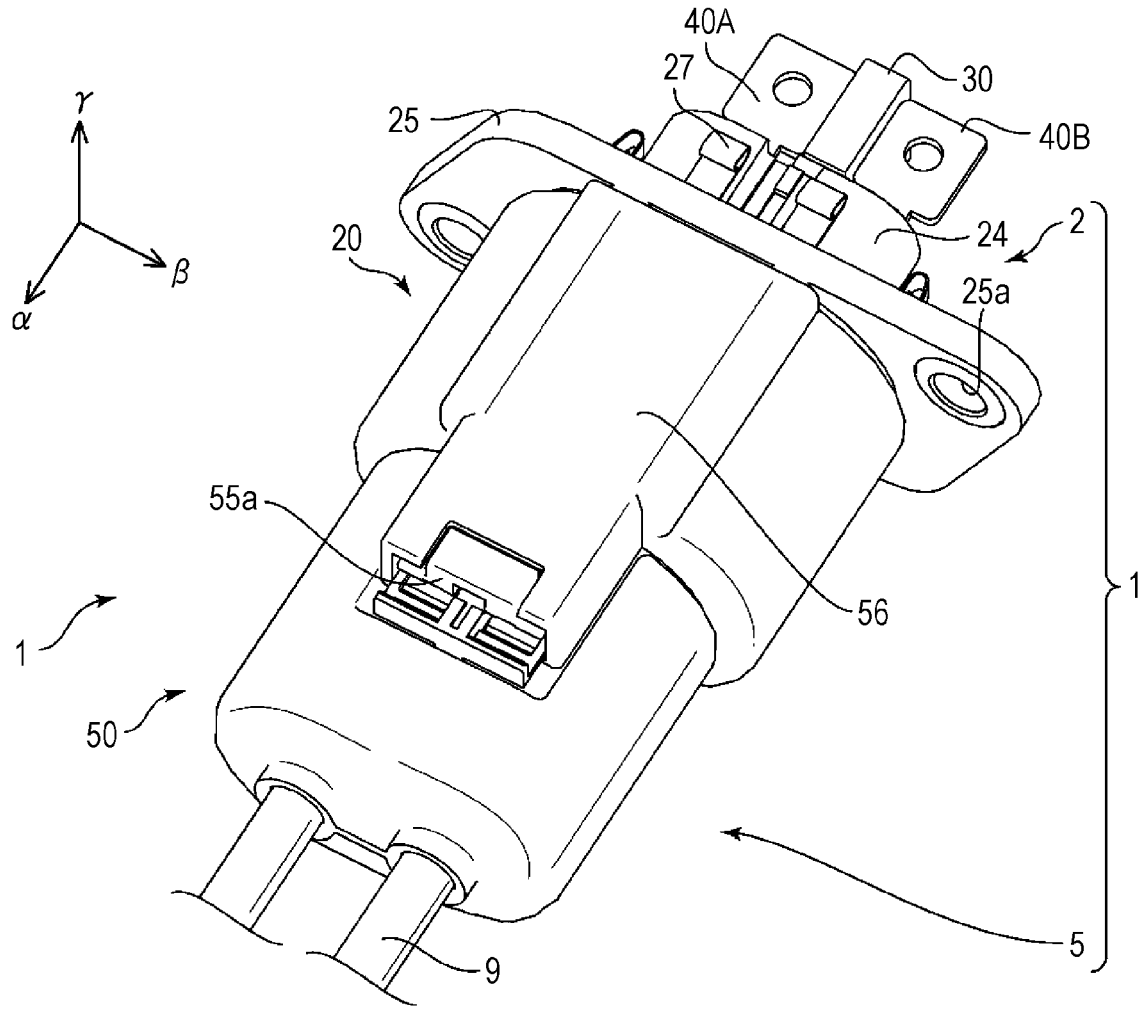
FIG. 1 is a perspective view of a power connector device according to one embodiment of the present invention.
Figure 2:
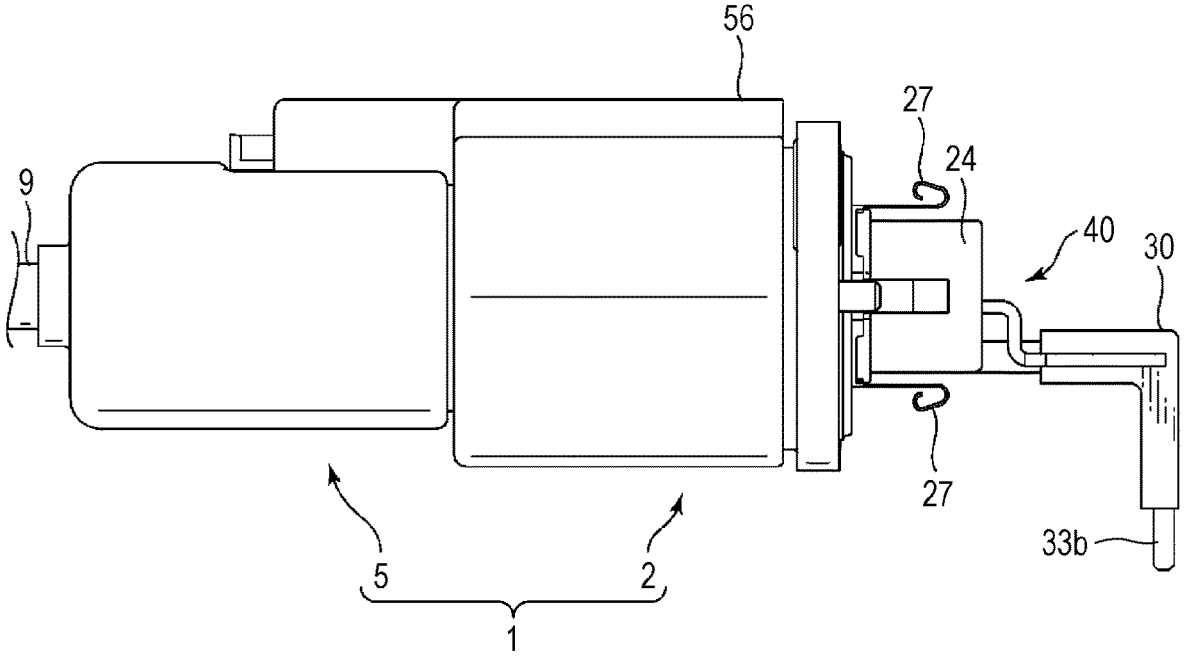
FIG. 2 is a side view of the power connector device of FIG. 1.
Figure 3:
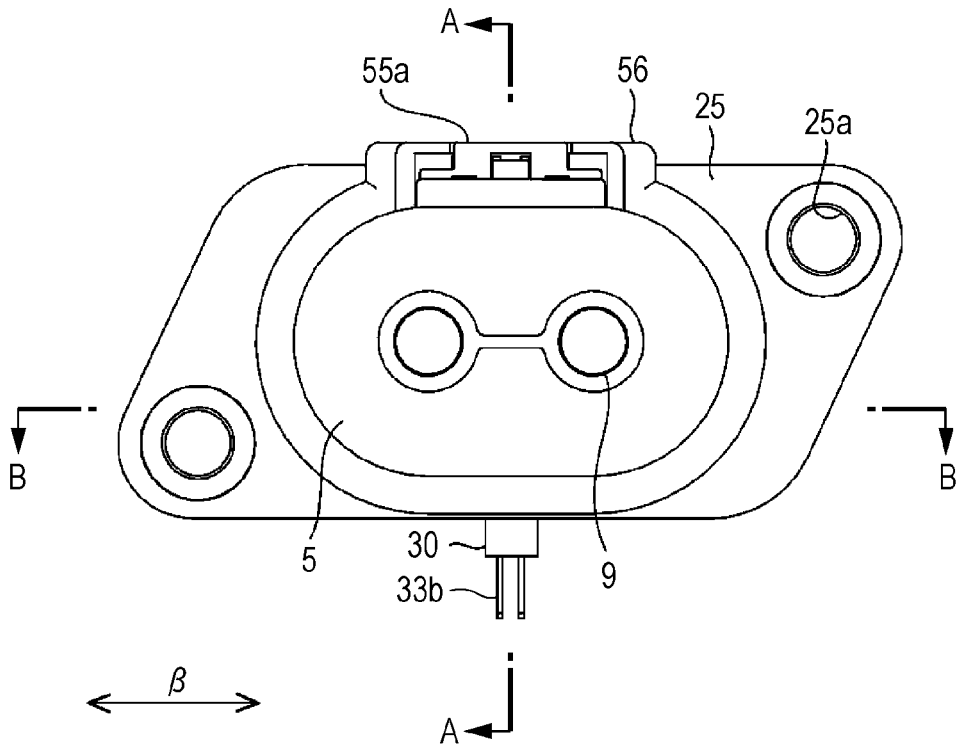
FIG. 3 is a back view of the power connector device of FIG. 1.
Figure 4:
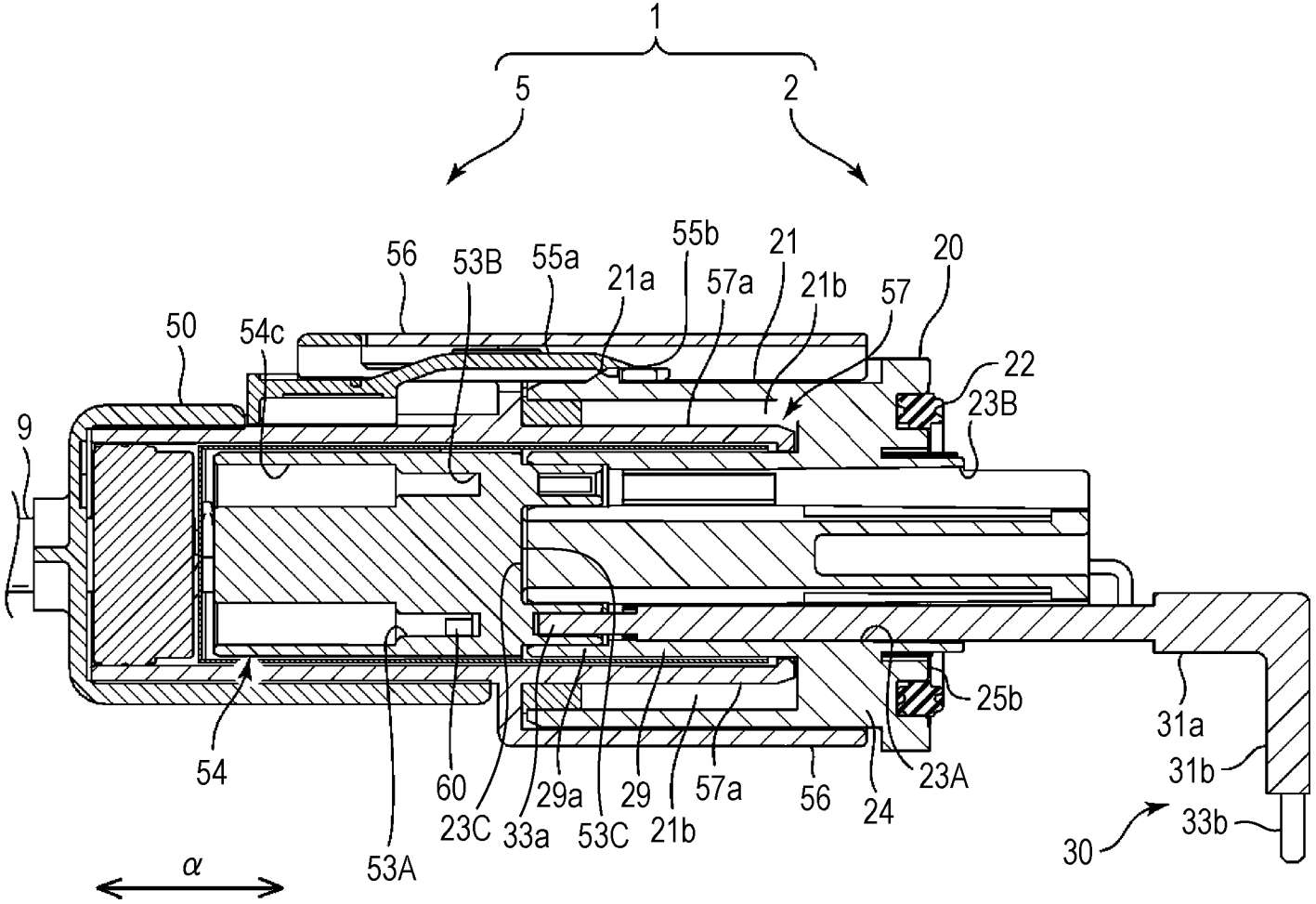
FIG. 4 is a sectional view along an A-A line of FIG. 3.
Figure 5:
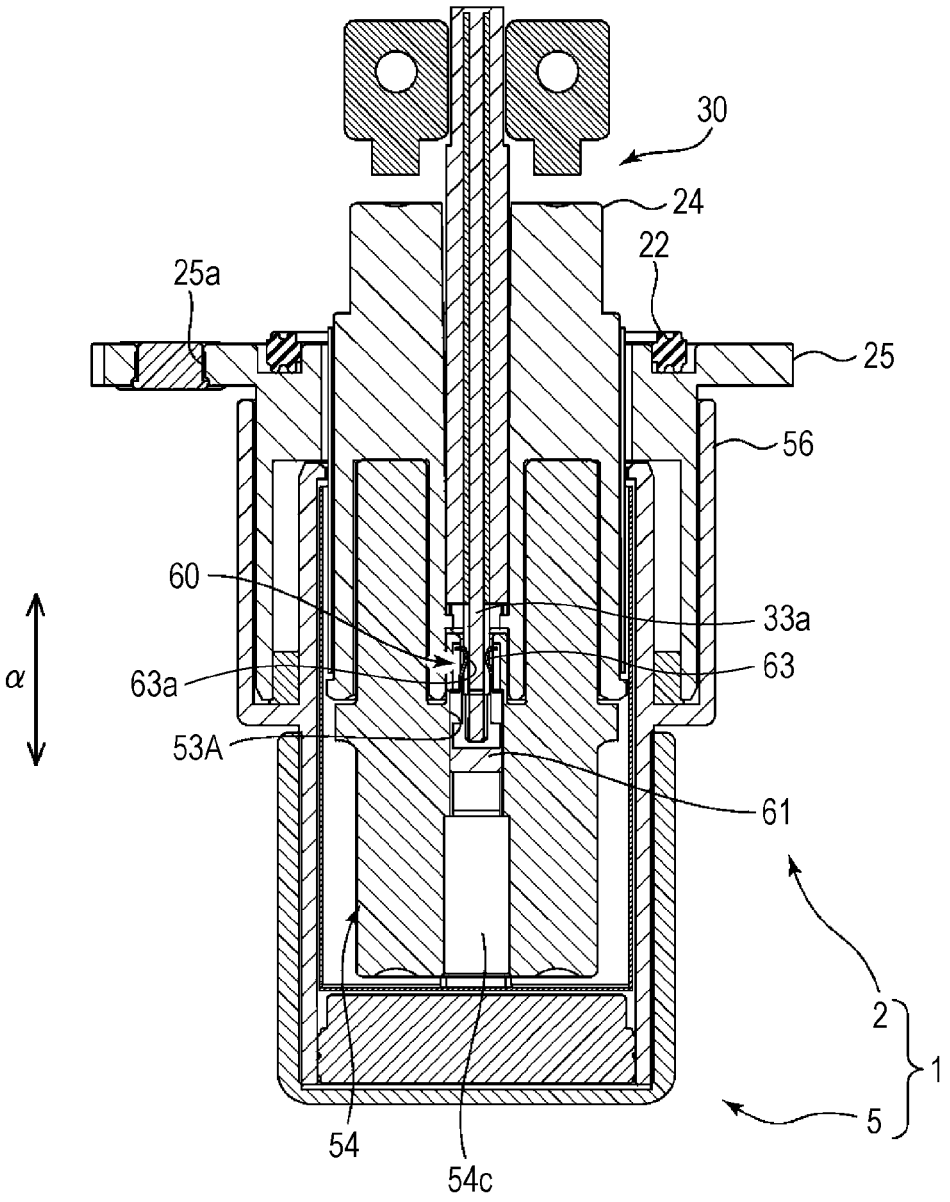
FIG. 5 is a sectional view along a B-B line of FIG. 4.

FIGS. 1 to 5 illustrate a power connector device 1 according to one embodiment of the present invention, the power connector device 1 being used in a power system of an automobile, for example. FIG. 1 is a perspective view of the power connector device 1, FIG. 2 is a side view thereof, FIG. 3 is a back view thereof, FIG. 4 is a sectional view along an A-A line of FIG. 3, and FIG. 5 is a sectional view along a B-B line of FIG. 3. The power connector device 1 includes, for example, a pair of a male connector 2 according to one embodiment of the present invention and a female connector 5 according to one embodiment of the present invention, the male connector 2 and the female connector 5 being able to be fittably connected to each other. FIGS. 1 to 5 illustrate a state after the male connector 2 and the female connector 5 have been fittably connected to each other. The male connector 2 and the female connector 5 can be fittably connected to each other along a fitting direction "α," and can be disconnected from each other.

The female connector 5 can be, for example, used as a cable connector with the female connector 5 being fixed to one end of a cable 9. On the other hand, the male connector 2 can be, for example, used in a state in which the male connector 2 is fixed to a housing (not shown). Attachment to the housing is, for example, performed in the following method.

The back of a flange 25, i.e., an annular portion 25*b* of a terminal support portion 24 of the male connector 2 protruding to a side fixed to the housing, is inserted into a wall hole of the housing along the fitting direction "α," and in a state in which a packing 22 is sandwiched between the flange 25 and a wall surface of the housing, an attachment spring 27 provided at each of upper and lower surfaces of the terminal support portion 24 is sandwiched by the wall hole. Thereafter, fixing to the housing wall surface with screws is performed utilizing screw holes 25*a* provided at the flange 25.

A locking unit may be provided to lock fittable connection between the male connector 2 and the female connector 5. A locking protrusion 21*a* protruding upward is, as the locking unit, provided on an upper surface of an outermost shell 21 of a housing 20 of the male connector 2. A locking piece 55*a* extending in the shape of a cantilever along the fitting direction "α" toward a side fittably connected to the male connector 2 is provided corresponding to the locking protrusion 21*a* inside an outermost shell 56 of a housing 50 of the female connector 5. Upon fittable connection between the male connector 2 and the female connector 5, the locking protrusion 21*a* of the housing 20 of the male connector 2 extends into the inside of the outermost shell 56 of the housing 50 of the female connector 5, and a locking protrusion 55*b* provided at a tip end of the locking piece 55*a* is locked at the locking protrusion 21*a* provided at the outermost shell 56 of the male connector 2.

The state of fittable connection between the male connector 2 and the female connector 5 can be sensed utilizing a typically-known interlock function. For providing the interlock function, an interlock connector 30 (see FIGS. 1 to 5) is provided at the male connector 2, whereas an interlock connector 60 (FIGS. 4 and 5) is provided at the female connector 5, for example.

Figure 6:
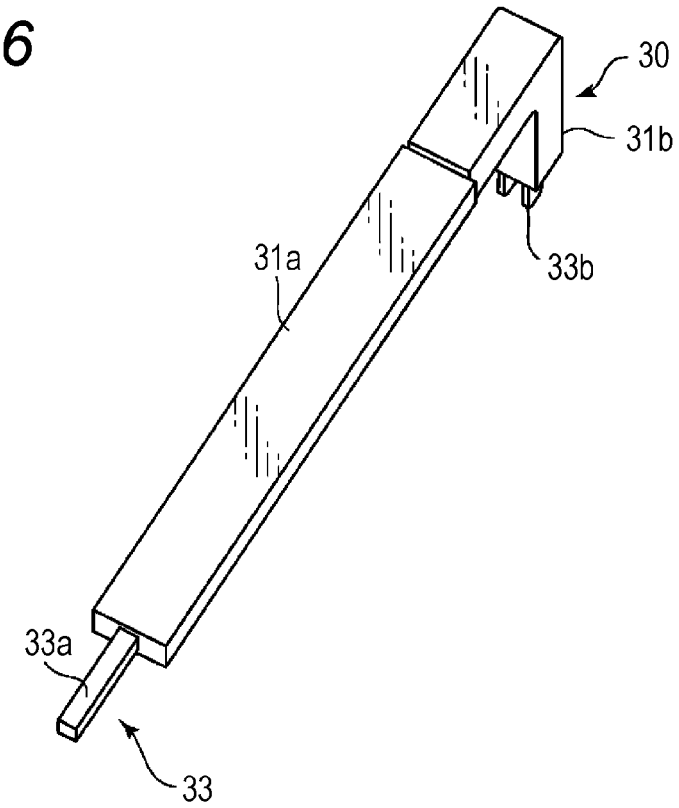
FIG. 6 is a perspective view of one example of an interlock connector provided at a male connector according to one embodiment of the present invention.
Figure 7:
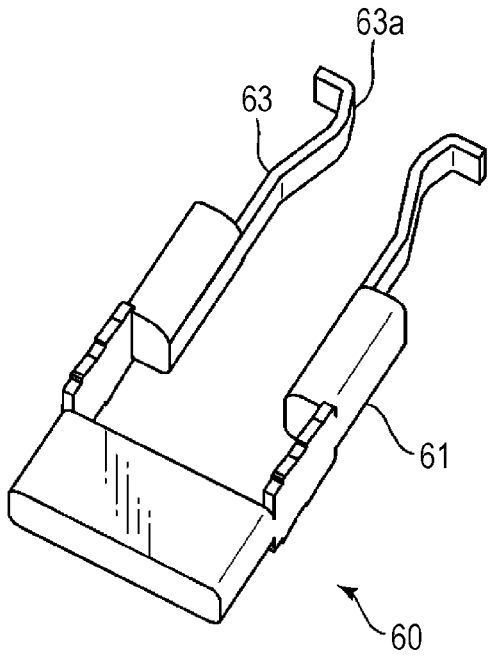
FIG. 7 is a perspective view of one example of an interlock connector provided at a female connector according to one embodiment of the present invention.

FIGS. 6 and 7 each illustrate perspective views of the interlock connectors 30, 60. The interlock connector 30 is, as viewed laterally, in a substantially L-shape including a long shaft 31*a* and a short shaft 31*b*. A conductive portion 33 connects both of the long shaft 31*a* and the short shaft 31*b*. Upon actual use, one end side of the long shaft 31*a* of the interlock connector 30 is inserted into any of two attachment portions 23A, 23B provided at the terminal support portion 24 of the housing 20 of the male connector 2 toward the side of fittable contact between the male connector 2 and the female connector 5. In this case, part of the long shaft 31*a* and the short shaft 31*b* are kept exposed through the attachment portion 23A, 23B. Note that in the present specification and the drawings, characters "A," "B" are used as necessary when members with the same structure are distinguished from each other (the same applies hereinafter). For example, determination on whether the interlock connector 30 is attached to the attachment portion 23A or the attachment portion 23B is made according to the direction of attachment of the connector to, e.g., the housing. One end 33*a* of the conductive portion 33 projecting from one end of the long shaft 31*a* inserted into the attachment portion 23A, 23B is used as a portion which is to contact a predetermined portion (63) of the interlock connector 60 of the female connector 5. On the other hand, the other end 33*b* of the conductive portion 33 projecting from one end of the short shaft 31*b* is used in a state in which the other end 33*b* is fixed to a substrate (not shown) provided inside the housing.

The interlock connector 60 includes a body portion 61 and two elastic contact pieces 63 elastically displaceably provided at end portions of the body portion 61, and as a whole, is in a substantially U-shape as viewed from above. Because of the U-shape, the function of short-circuiting a circuit can be provided. Upon actual use, the interlock connector 60 is inserted into any of two attachment portions 53A, 53B provided at a terminal support portion 54 of the housing 50 of the female connector 5 toward the side of fittable contact between the male connector 2 and the female connector 5 through an insertion port 54*c* (see FIG. 5), and is placed inside the terminal support portion 54. Determination on whether the interlock connector 60 is attached to the attachment portion 53A or the attachment portion 53B is made according to an attachment position of the interlock connector 30. As clearly illustrated in FIG. 5, upon fittable connection between the male connector 2 and the female connector 5, one end 33*a* of the conductive portion of the interlock connector 30 is sandwiched between the separated narrow elastic contact pieces 63 of the interlock connector 60, and as a result, the flow of an electric signal is generated between the interlock connector 30 and the interlock connector 60. By sensing such an electric signal, the state of fittable connection between the male connector 2 and the female connector 5 is determined. Note that for reliably performing contact with the conductive portion 33*a*, a contact point 63*a* is preferably formed at the elastic contact piece 63.

Figure 8:
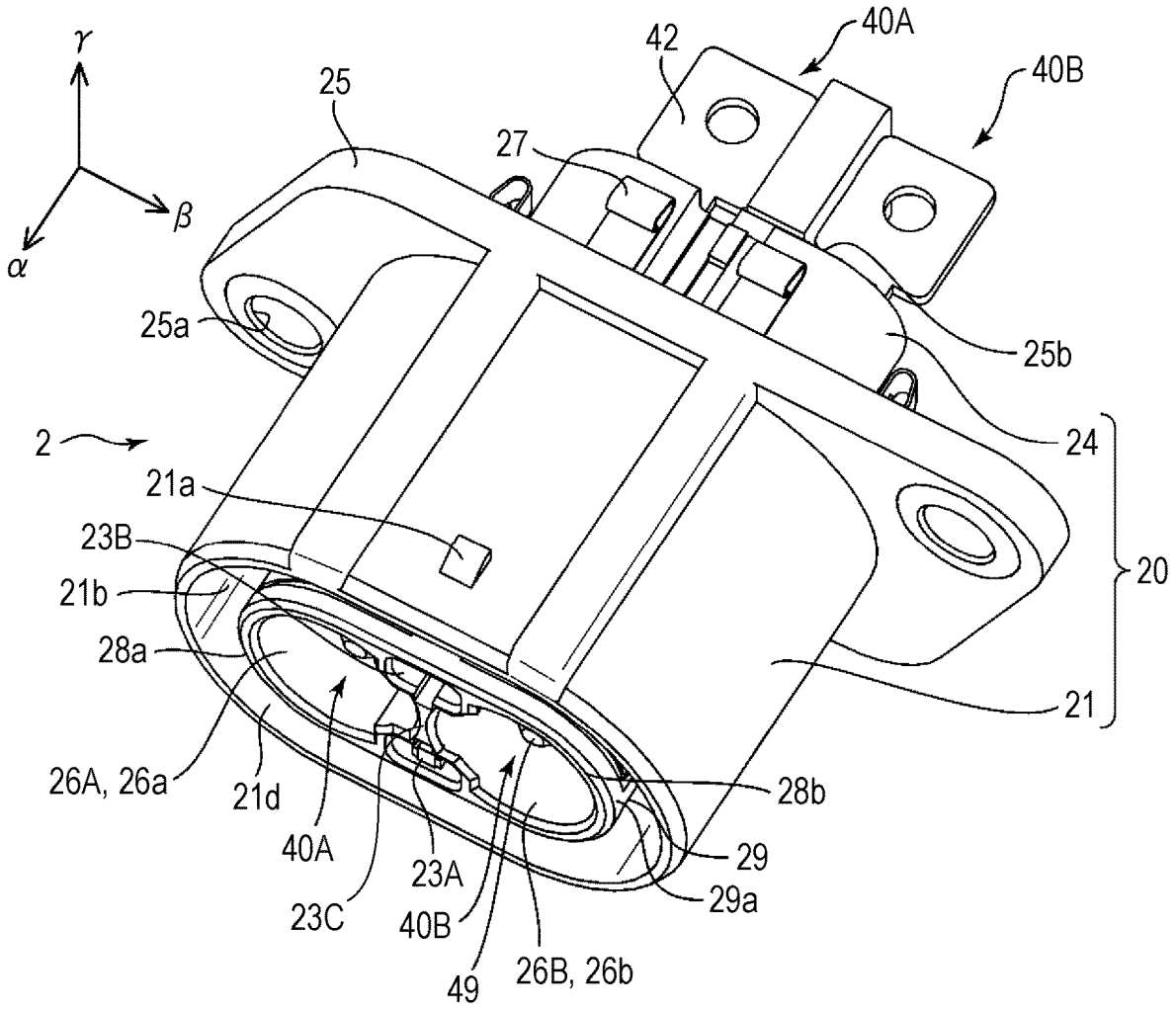
FIG. 8 is a perspective view of the male connector.
Figure 9:
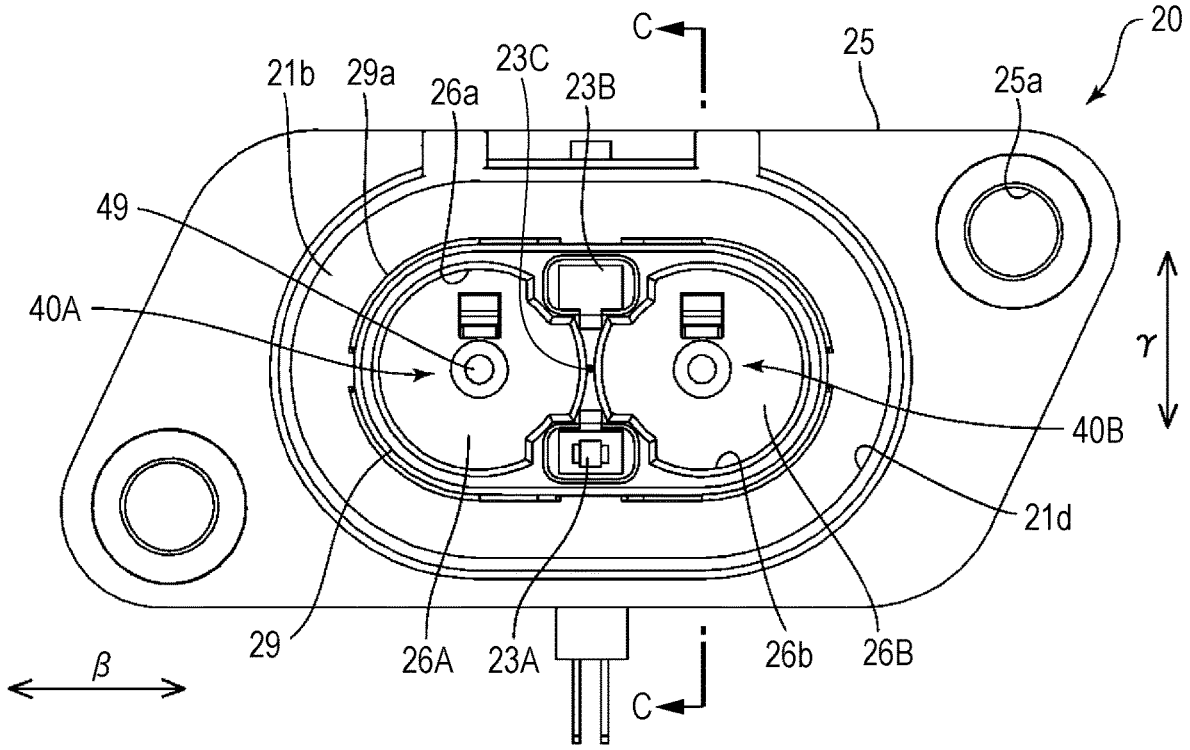
FIG. 9 is a front view of the male connector.
Figure 10:
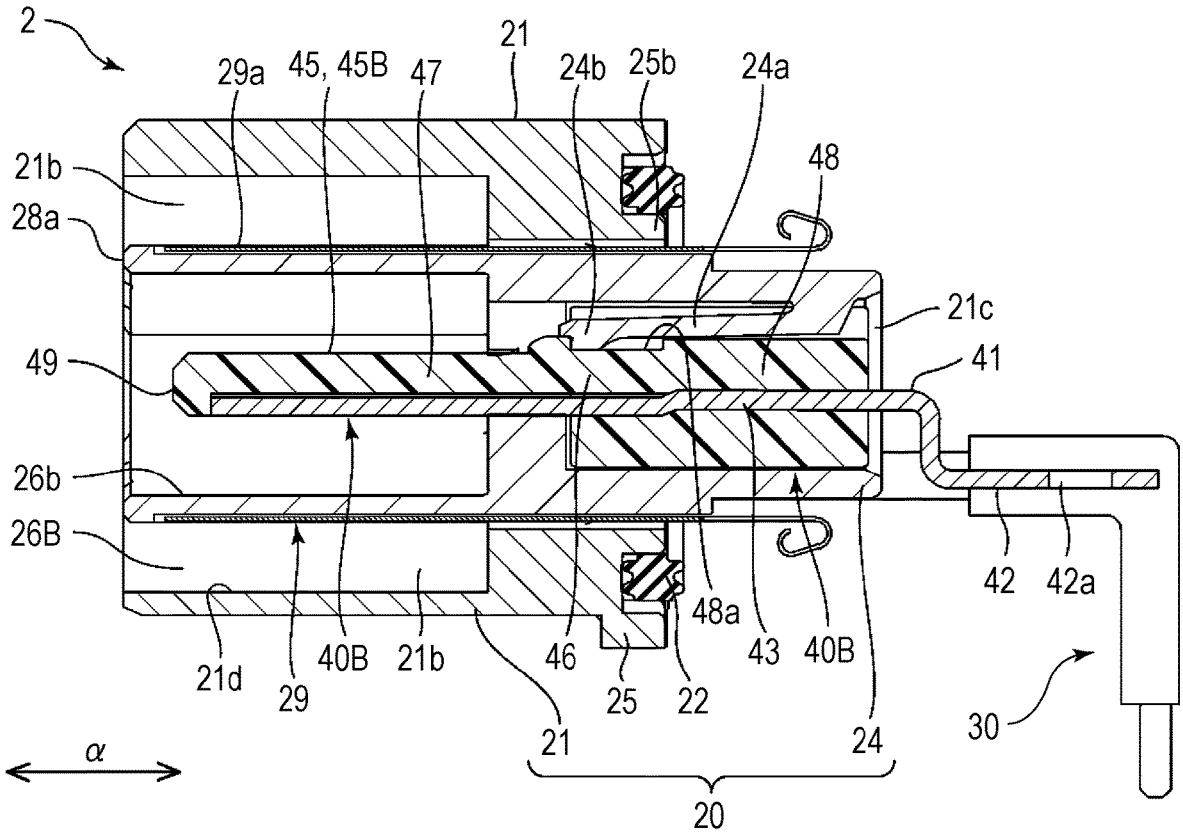
FIG. 10 is a sectional view along a C-C line of FIG. 9.
Figure 11:
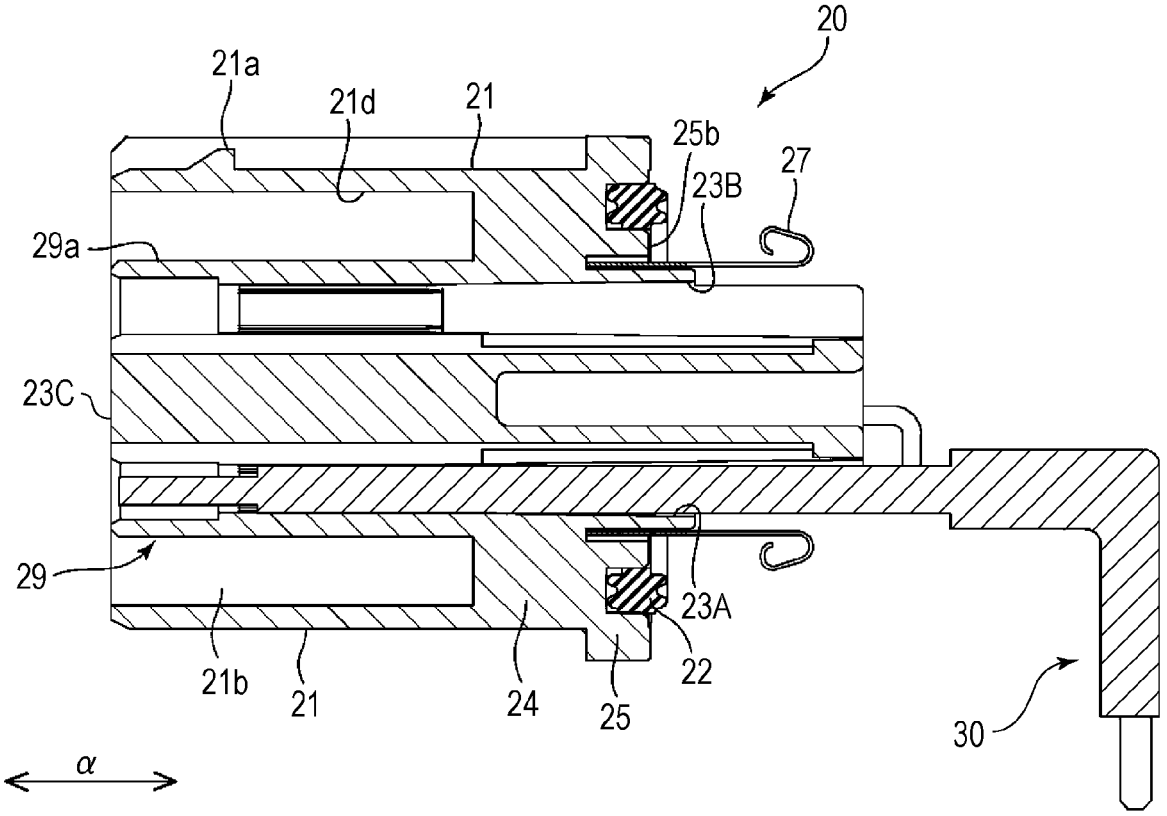
FIG. 11 is a sectional view corresponding to the sectional view of FIG. 4, FIG. 11 illustrating only the male connector.

FIGS. 8 to 11 illustrate views of the individual male connector 2, i.e., illustrate the male connector 2 before fittable connection between the male connector 2 and the female connector 5 or after disconnection of the male connector 2 and the female connector 5 from each other. FIG. 8 is a perspective view of the male connector 2, FIG. 9 is a front view thereof, FIG. 10 is a sectional view along a C-C line of FIG. 9, and FIG. 11 illustrates only the male connector 2 in the sectional view of FIG. 4.

The male connector 2 includes the housing 20, terminals 40A, 40B detachably attached to the housing 20, and the interlock connector 30 (see FIG. 1 etc.). The terminals 40A, 40B and the interlock connector 30 are detachable from the housing 20.

The housing 20 includes the outermost shell 21 and the terminal support portion 24. The outermost shell 21 covers, in an annular shape, the outside of a front protruding portion 29 as part of the terminal support portion 24 protruding to a side fittably connected to the female connector 5. For facilitating fixing of the male connector 2 to, e.g., the housing, the above-described flange 25 may be further provided.

The outermost shell 21 and the front protruding portion 29 substantially have bilaterally-symmetrical shapes on the side of fittable connection between the male connector 2 and the female connector 5. By employing the symmetrical shape, it is not necessary to take the directions of the male connector 2 and the female connector 5 into consideration upon fittable connection between the male connector 2 and the female connector 5. The phrase of "substantially have bilaterally-symmetrical shapes" means that it is enough to provide symmetry to such an extent that the direction of fittable connection between the male connector 2 and the female connector 5 causes no problem upon fittable connection (the same applies hereinafter).

Both of the outermost shell 21 and the terminal support portion 24 extend along the fitting direction "α," and are formed in a substantially tubular shape. As clearly illustrated in FIG. 9, an inner surface 21*d* of the outermost shell 21 and an outer surface 29*a* of the front protruding portion 29 of the terminal support portion 24 are in concentric flat oval sectional shapes, and the front protruding portion 29 is positioned at the substantially center of the outermost shell 21. Such a sectional shape forms a surface abutting on a predetermined member of the female connector 5, and therefore, it may be understood that FIG. 9 substantially illustrates the surface of the male connector 2 abutting on the predetermined member of the female connector 5. The diameter of the inner surface 21*d* of the outermost shell 21 is greater than the diameter of the outer surface 29*a* of the front protruding portion 29, and therefore, an annular fitting recessed portion 21*b* is formed between these portions. A predetermined portion of the female connector 5 can be fitted in the fitting recessed portion 21*b* upon fittable connection between the male connector 2 and the female connector 5.

The terminal support portion 24 includes, specifically at an abutting surface of the front protruding portion 29 of the terminal support portion 24, two fitting portions 26A, 26B in which predetermined portions (52A, 52B) of the female connector 5 are to be fitted, and the attachment portions 23A, 23B to which the interlock connector 30 is to be attached. At such an abutting surface, the fitting portions 26A, 26B are arrayed in a lateral direction along a direction "β" perpendicular to the fitting direction "α," The fitting portions 26A, 26B are formed as recessed portions recessed along the fitting direction "α," and are formed as bottomed tubular portions. An inner peripheral edge of the fitting recessed portion 26A is defined by an inner wall 26*a* of the tube, and similarly, an inner peripheral edge of the fitting recessed portion 26B is defined by an inner wall 26*b* of the tube. These inner peripheral edges 26*a*, 26*b* have, for example, shapes slightly recessed inward at positions corresponding to the attachment portions 23A, 23B. As in the fitting recessed portions 26A, 26B, the attachment portions 23A, 23B are also provided along the fitting direction "α," and are formed as recessed portions. Note that these portions are not formed in a tubular shape, but are formed as through-holes.

The terminals 40A, 40B are each inserted into the fitting recessed portions 26A, 26B through an insertion port 21*c* provided at the terminal support portion 24 from a back end side of the terminal support portion 24, i.e., the opposite side of the surface abutting on the predetermined member of the female connector 5, and are each placed in the fitting recessed portions 26A, 26B. Upon placement in the fitting recessed portions 26A, 26B, tip-end-side terminal portions (tubular portions) 45 of the terminals 40A, 40B extend along the fitting direction "α" in a fitting space formed by the fitting recessed portions 26A, 26B, and at the abutting surface, are positioned at the substantially centers of the inner peripheral edges 26*a*, 26*b* of the fitting recessed portions 26A, 26B.

One end 49 of each of the terminals 40A, 40B on the side of the surface abutting on the predetermined member of the female connector 5 is covered utilizing a resin member 46. The resin member covering one end 49 functions as a finger protection. One end 49 is, in the fitting direction "α," at a position recessed to the opposite side of the side of fittable connection between the male connector 2 and the female connector 5, i.e., the opposite side of the side of fitting in the predetermined portions (52A, 52B) of the female connector 5, with respect to a fitting inlet 28*a*, 28*b* of the fitting recessed portion 26A, 26B. Since the tip ends 49 are at these positions, the function as the finger protection can be enhanced.

Note that the outline of a terminal portion 45 at the abutting surface is preferably a substantially circular shape. With the substantially circular shape, the male connector 2 can be downsized in the array direction "β" of the fitting recessed portion 26A, 26B as compared to the case of a flat plate shape, for example. For fixing the terminals 40A, 40B, locking pieces 24*a* extending toward the abutting surface from the insertion port 21*c* are provided at the terminal support portion 24. At tip ends of the locking pieces 24*a*, locking protrusions 24*b* to be locked at predetermined portions of the terminals 40A, 40B are provided.

Figure 12:
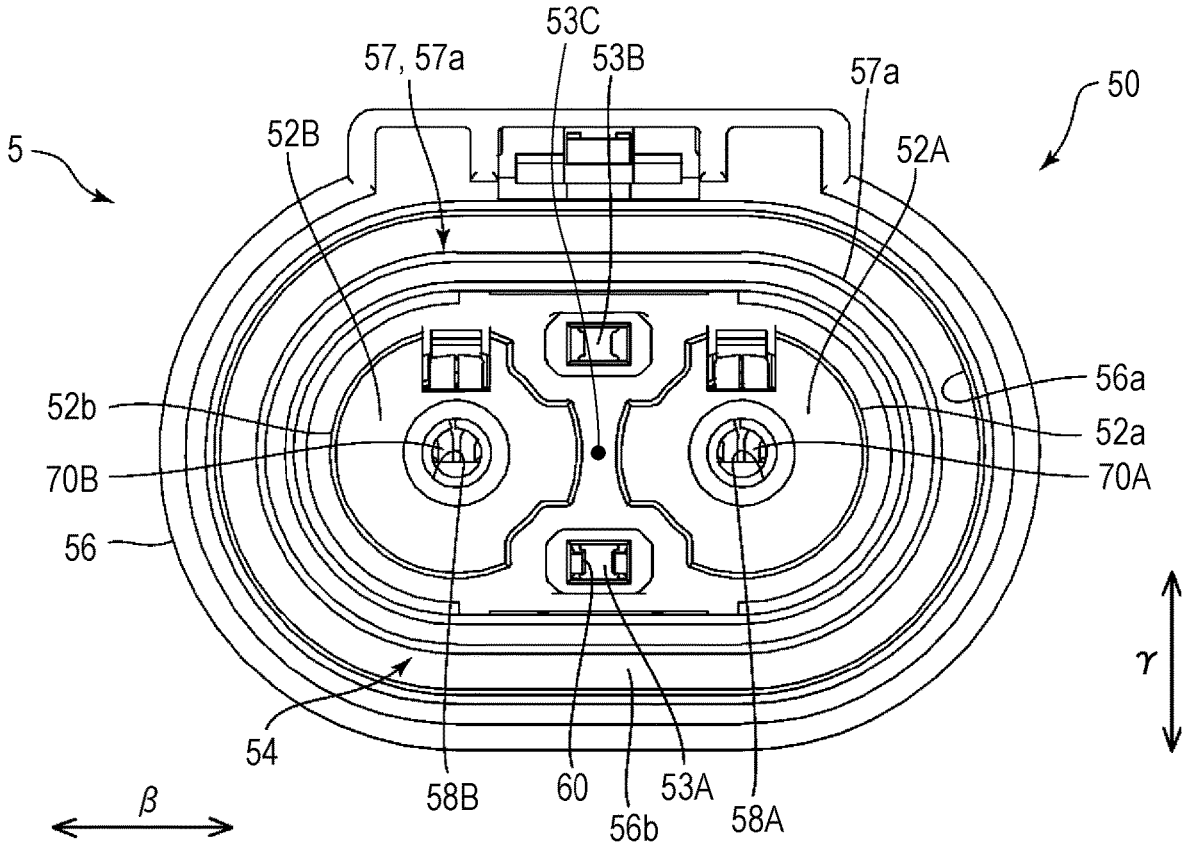
FIG. 12 is a front view of the female connector.
Figure 13:
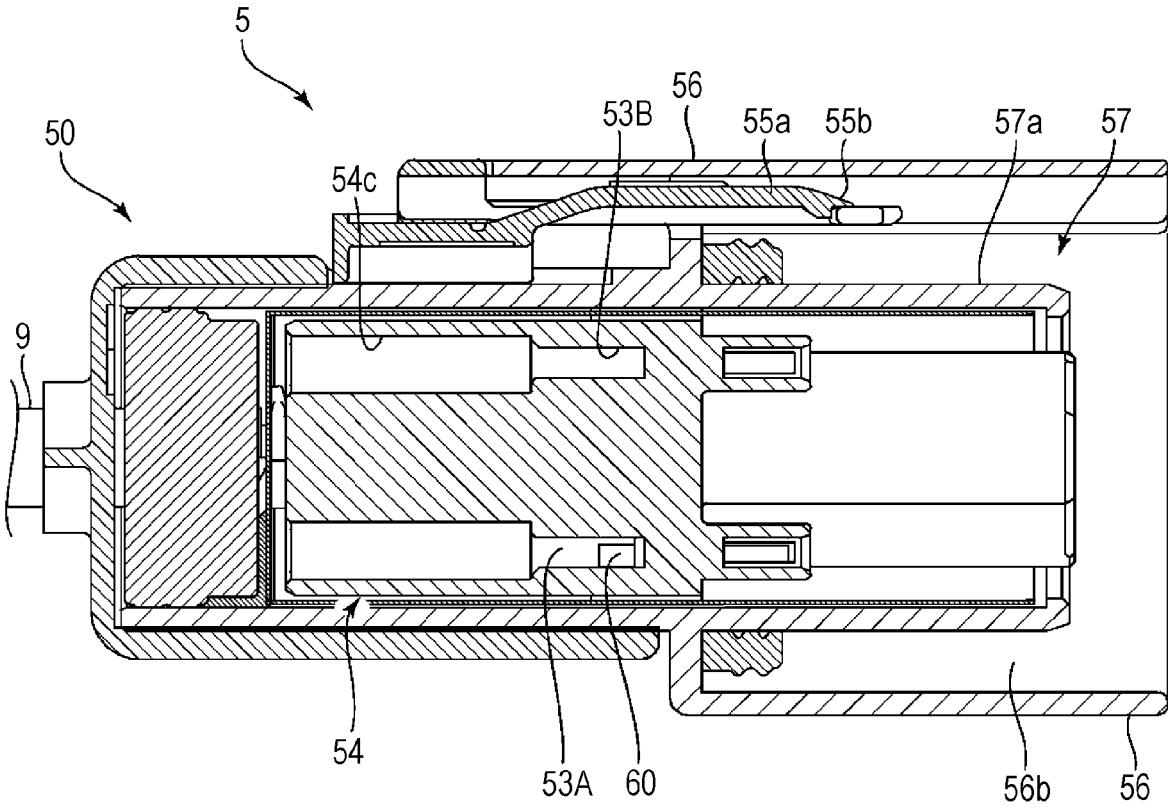
FIG. 13 is a sectional view corresponding to the sectional view of FIG. 4, FIG. 13 illustrating only the female connector.

FIG. 12 illustrates a front view of the female connector 5, and FIG. 13 illustrates the female connector 5 in the sectional view of FIG. 4. FIGS. 12 and 13 each correspond to FIGS. 9 and 10 illustrating the male connector 2.

As in the male connector 2, the female connector 5 includes the housing 50, terminals 70A, 70B attached to the housing 50, and the interlock connector 60 (see FIG. 5 etc.). The terminals 70A, 70B and the interlock connector 60 may be detachable from the housing 50.

The housing 50 includes the outermost shell 56 and the terminal support portion 54. The outermost shell 56 covers, in an annular shape, the outside of a front protruding portion 57 as part of the terminal support portion 54 protruding to the side fittably connected to the male connector 2. The terminals 70A, 70B are supported by the terminal support portion 54, and one end of the cable 9 is fixed to the terminal support portion 54.

The outermost shell 56 and the front protruding portion 57 substantially have bilaterally-symmetrical shapes on the side of fittable connection between the male connector 2 and the female connector 5. By employing the symmetrical shape, it is not necessary to take the directions of the male connector 2 and the female connector 5 into consideration upon fittable connection between the male connector 2 and the female connector 5.

Both of the outermost shell 56 and the terminal support portion 54 extend along the fitting direction "α." Moreover, the outermost shell 56 is formed as a substantially-tubular member, and on the other hand, the front protruding portion 57 of the terminal support portion 54 has a substantially-tubular outline shape as in the outermost shell 56. As clearly illustrated in FIG. 12, an inner surface 56*a* of the outermost shell 56 and an outer surface 57*a* of the front protruding portion 57 of the terminal support portion 54 are in concentric flat oval sectional shapes, and the front protruding portion 57 is positioned at the substantially center of the outermost shell 56. Such a sectional shape forms a surface abutting on a predetermined member of the male connector 2, i.e., a surface abutting on the outermost shell 21 and the terminal support portion 24, and therefore, it may be understood that FIG. 12 substantially illustrates the surface of the female connector 5 abutting on the predetermined member of the male connector 2. The diameter of the inner surface 56*a* of the outermost shell 56 is greater than the diameter of the outer surface 57*a* of the front protruding portion 57, and therefore, an annular fitting recessed portion 56*b* is formed between these portions. The outermost shell 21 of the male connector 2 is fitted in the fitting recessed portion 56*b* upon fittable connection between the male connector 2 and the female connector 5.

The terminal support portion 54 includes, specifically at an abutting surface of the front protruding portion 57 of the terminal support portion 54, two fitting portions 52A, 52B in which predetermined portions (26A, 26B) of the male connector 2 are to be fitted, and the attachment portions 53A, 53B to which the interlock connector 60 is to be attached. At such an abutting surface, the fitting portions 52A, 52B are arrayed in the lateral direction along the direction "β" perpendicular to the fitting direction "α." The fitting portions 52A, 52B are formed as raised portions protruding along the fitting direction "α." An outer peripheral edge of the fitting raised portion 52A is defined by an outer wall 52*a* of the fitting raised portion 52A itself, and on the other hand, an outer peripheral edge of the fitting raised portion 52B is defined by an outer wall 52*b* of the fitting raised portion 52B itself. These outer peripheral edges 52*a*, 52*b* have, corresponding to the shapes defined by the inner peripheral edges 26*a*, 26*b* of the fitting recessed portions 26A, 26B, shapes slightly recessed inward at positions corresponding to the attachment portions 53A, 53B, for example. Note that the fitting recessed portions 26A, 26B and the fitting raised portions 52A, 52B are enough to form shapes complementing each other, and any fitting portion may be formed as the recessed portion or the raised portion.

The terminals 70AA, 70B are placed in terminal insertion holes 58A, 58B each provided at the substantially centers of the outer peripheral edges 52*a*, 52*b* of the fitting raised portions 52A, 52B in a state in which the terminals 70A, 70B do not interfere with insertion of the terminal portions 45 of the terminals 40A, 40B.

As clearly seen from, e.g., description above, the male connector 2 and the female connector 5 substantially form complementary shapes at the abutting surface (see FIGS. 9 and 12). The phrase of "substantially form complementary shapes" means that it is enough to have the complementary shapes to such an extent that fitting is not interfered. Upon finable connection between the male connector 2 and the female connector 5, the fitting recessed portions 26A, 26B of the male connector 2 and the fitting raised portions 52A, 52B of the female connector 5 are fitted to each other along the fitting direction "α" in a state in which these portions abut on each other at the abutting surfaces.

In this state, the fitting raised portions 52A, 52B of the female connector 5 are each fitted in the fitting recessed portions 26A, 26B of the male connector 2. As a result, the terminals 40A, 40B of the male connector 2, specifically terminal portions 45A, 45B thereof, are each inserted into the terminal insertion holes 58A, 58B provided at the fitting raised portions 52A, 52B of the female connector 5, and the terminals 40A, 40B and the terminals 70A, 70B placed in the terminal insertion holes 58A, 58B are electrically connected to each other.

Moreover, in this state, the wall 57*a* defining the outline of the front protruding portion 57 of the terminal support portion 54 of the female connector 5 is inserted into the fitting recessed portion 21*b* formed by the outermost shell 21 and the front protruding portion 29 of the male connector 2, and the outermost shell 21 of the male connector 2 is further inserted into the fitting recessed portion 56*b* formed by the outermost shell 56 and the front protruding portion 57 of the female connector 5.

As a result, as clearly illustrated in FIGS. 4 and 5, the conductive portion 33*a* at a tip end of the interlock connector 30 provided at the male connector 2 sandwiched between the elastic contact pieces 63 of the interlock connector 60 provided at the female connector 5, and these portions are in conduction with each other.

With the interlock connectors 30, 60, enlargement of the male connector 2 and the female connector 55 in the array direction "β" of the fitting recessed portions 26A, 26B and the fitting raised portions 52A, 52B is prevented. Thus, as clearly illustrated in FIGS. 4, 8, 9, and 11, the attachment portions 23A, 23B are, at the abutting surface, positioned between the inner peripheral edges 26*a*, 26*b* of the fitting portions 26A, 26B, and are arranged in a region excluding a most-proximal portion 23C where the inner peripheral edges 26*a*, 26*b* are closest to each other in the array direction "β" Similarly, as clearly illustrated in FIGS. 4, 12, and 13, the attachment portions 53A, 53B are, at the abutting surface, positioned between the outer peripheral edges 52*a*, 52*b* of the fitting portions 52A, 52B, and are arranged in a region excluding a most-proximal portion 53C where the outer peripheral edges 52*a*, 52*b* are closest to each other in the array direction "β" The attachment portions 23A, 23B are, at the abutting surface, positioned at the center between the fitting portions 26A, 26B in the array direction "β" and the attachment portions 53A, 53B are, at the abutting surface, similarly positioned at the center between the fitting portions 52A, 52B in the array direction "β"

As described above, the attachment portions are provided in the regions excluding the most-proximal portions 23C, 53C, and therefore, enlargement of the dimension of the connector in the fitting direction "β" can be prevented.

Note that as clearly illustrated in FIGS. 9 and 12, the attachment portions 23A, 23B and the attachment portions 53A, 53B are preferably provided at positions sandwiching the most-proximal portions 23C, 53C in a direction "γ" perpendicular to both of the fitting direction "α" and the array direction "β". With this configuration, even in a case where the power connector is attached to, e.g., a substrate in any of upper and lower directions, the interlock connector can be easily attached.

As clearly seen from FIG. 10 etc., the terminal 40 includes a metal member 41 and the resin member 46 molded integrally with the metal member 41. The metal member 41 can be, for example, formed in such a manner that a relatively-thick metal plate-shaped body having a thickness of about 1.2 mm is processed by, e.g., cutting, bending, and rounding. The metal member 41 roughly includes a fixing portion 42, an intermediate portion 43, and the tubular portion 45. The resin member 46 is molded only for the intermediate portion 43 and the tubular portion 45, and is not molded for the fixing portion 42. The resin member 46 includes a cover portion 48 covering the outside of the metal member 41, more specifically part of the tubular portion 45 and the entirety of the intermediate portion 43. The cover portion 48 covers only part of the tubular portion 45, and therefore, at least part of the tubular portion 45, preferably the substantially entirety of the tubular portion 45, is kept exposed to the outside. Using such a portion exposed to the outside, the tubular portion 45, i.e., the metal member 41, physically contacts the partner terminal 70.

The terminal 40 can be, for example, also attached to the housing 20 by means of the cover portion 48. At the cover portion 48, a groove 48*b* is provided corresponding to a groove (not shown) provided at the housing 20 along the fitting direction "α." The terminal 40 is inserted into the terminal support portion 24 along the groove 48*b* through the insertion port 21*c* provided at the terminal support portion 24. For fixing the terminal 40 at a predetermined position of the housing 20, a locking recessed portion 48*a* is provided at an upper portion of the cover portion 48. When the terminal 40 reaches a predetermined position of the terminal support portion 24, the locking protrusion 24*b* of the locking piece 24*a* provided at the terminal support portion 24 is fitted in the locking recessed portion 48*a* provided at the cover portion 48, and as a result, the terminal 40 is fixed to the housing 20. In this state, the tubular portion 45 is arranged along the fitting direction "α" in a state contactable with the partner terminal 70 in the fitting space formed by the fitting recessed portions 26A, 26B.

It should be understood that description above relates to the preferred embodiment and merely represents an article. It can be recognized that variations and corrections as different embodiments are easily apparent to those skilled in the art according to the above-described teachings. Thus, exemplary embodiments and alternative embodiments can be made without departing from the spirit of the article described in the attached claims.

LIST OF REFERENCE NUMERALS

2 male connector
5 female connector
20 housing
23A, 23B attachment portion
23C, 53C most-proximal portion
26A, 26B fitting recessed portion
26*a*, 26*b* inner peripheral edge (inner wall) of fitting recessed portion
30 interlock connector
40A, 40B terminal
41 metal member
45 tubular portion (terminal portion)
46 resin member
47 charging portion
48 cover portion
50 housing
52A, 52B fitting raised portion
52*a*, 52*b* outer peripheral edge (outer wall) of fitting raised portion
53A, 53B attachment portion
60 interlock connector
70A, 70B terminal

The invention claimed is:

1. A power connector comprising:

a housing having at least two fitting portions each fittable to at least two partner fitting portions of a partner connector in an abutting state;

at least two terminals each arranged at the at least two fitting portions; and at least one interlock connector attached to an attachment portion of the housing, wherein when the at least two fitting portions and the at least two partner fitting portions are fitted to each other, the at least two terminals are each electrically connected to at least two partner terminals each provided at the at least two partner fitting portions, and the at least one interlock connector is configured to be in conduction with a partner interlock connector provided at the partner connector, at an abutting surface of the at least two fitting portions and the at least two partner fitting portions, the attachment portion is positioned between peripheral edges of the at least two fitting portions, and is arranged in a region excluding a most-proximal portion where the peripheral edges of the at least two fitting portions are closest to each other in an array direction of the at least two fitting portions, and at the abutting surface, the attachment portion includes at least two attachment portions provided at positions sandwiching the most-proximal portion in a direction perpendicular to both of a fitting direction of the at least two fitting portions and the at least two partner fitting portions and the array direction.

2. The power connector according to claim 1, wherein the abutting surface substantially has a bilaterally-symmetrical shape.

3. The power connector according to claim 2, wherein at the abutting surface, the attachment portion is positioned at a center between the at least two fitting portions in the array direction.

4. The power connector according to claim 1, wherein the at least two terminals each have terminal portions extending along the fitting direction of the at least two fitting portions and the at least two partner fitting portions when arranged at the at least two fitting portions, and the terminal portions are each electrically connected to the at least two partner terminals when the at least two fitting portions and the at least two partner fitting portions are fitted to each other.

5. The power connector according to claim 4, wherein at the abutting surface, each terminal portion is positioned at a substantially center of the peripheral edge of a corresponding one of the at least two fitting portions.

6. The power connector according to claim 4, wherein an outline of each terminal portion at the abutting surface is a substantially circular shape.

7. The power connector according to claim 6, wherein each terminal portion is formed in a tubular shape.

8. The power connector according to claim 1, wherein each of the at least two terminals is formed from a single plate-shaped body.

9. The power connector according to claim 1, wherein the at least two fitting portions are formed as recessed portions recessed along the fitting direction of the at least two fitting portions and the at least two partner fitting portions, and the at least two partner fitting portions are formed as raised portions protruding along the fitting direction.

10. A power connector device comprising:

the power connector according to claim 1 and the partner connector.

* * * * *